US005975957A

United States Patent [19]

Noda et al.

[11] Patent Number: 5,975,957

[45] Date of Patent: Nov. 2, 1999

[54] I/O CONNECTOR WITH RESILIENT CONNECTING MEANS

[75] Inventors: Atsuhito Noda, Hachiohji; Shouzou Ichikawa, Kawasaki; Naoya Matsuura, Yokohama, all of Japan

[73] Assignee: Molex Incorporated, Lisle, Ill.

[21] Appl. No.: 09/049,811

[22] Filed: Mar. 27, 1998

[30] Foreign Application Priority Data

Apr. 11, 1997 [JP] Japan ..... 9-110509

[51] Int. Cl.[6] ..... H01R 13/648

[52] U.S. Cl. ..... 439/609

[58] Field of Search ..... 439/609, 610, 439/862

[56] References Cited

U.S. PATENT DOCUMENTS

| | | | |
|---|---|---|---|
| 4,337,989 | 7/1982 | Asick et al. | 339/143 |
| 4,653,836 | 3/1987 | Peele | 339/143 |
| 5,254,010 | 10/1993 | Davis | 439/108 |
| 5,676,569 | 10/1997 | Davis | 439/731 |
| 5,766,041 | 6/1998 | Morin et al. | 439/609 |
| 5,797,770 | 8/1998 | Davis et al. | 439/607 |
| 5,899,772 | 5/1999 | Beaver et al. | 439/610 |

*Primary Examiner*—Gary F. Paumen
*Assistant Examiner*—Truc T. Nguyen
*Attorney, Agent, or Firm*—Charles S. Cohen

[57] ABSTRACT

A connector includes metal shield connecting means that improves the reliability of the connection between the connector and another connector. The connector includes a connector housing having a plurality of conductive terminals mounted therein, and a projection extending from the connector housing that encircles the terminals extending from the terminals. A metal shield surrounds the projection and includes connecting means to make a required electric connection with the metal shell of a mating electric connector. The connecting means includes at least one engagement member disposed in at least one recess formed in the projection. The engagement member has one or more contact portions that extend up through apertures formed in the metal shield.

20 Claims, 3 Drawing Sheets

I/O CONNECTOR WITH RESILIENT CONNECTING MEANS

BACKGROUND OF THE INVENTION

The present invention relates generally to connectors having means for engaging each other, and more particularly to input-output ("I/O") connectors having metal shields surrounding their connector bodies and means for resiliently establishing a connection between the metal shields of opposing connectors.

As is known, I/O connectors are used in establishing electrical connections between electronic devices, such as personal computers and their monitors or printers, as well as establishing connections between different electronic devices. Typically, such connectors have metal shells, or shields, that surround the contact terminals of the connectors to thereby shield the interconnection of these contact terminals to an opposing connector against electromagnetic interference.

This shielding may often not be satisfactorily assured unless a completely reliable connection is established between the metal shield of one connector and the metal shield of the opposing connector. To assure a good and reliable connection between the metal shields of engaged connectors, it is necessary to provide connecting means for the metal shields. One known connecting means utilizes a plurality of bosses formed on and projecting from the male shield of one connector that contact the female shield of an opposing connector when the male and female shields are engaged together.

Problems may arise with the use of such a connecting means in instances where either metal shield is partly bent. This bending may cause gaps that occur between the male and female shields when engaged together. These gaps prevent the establishment of a reliable connection along the lateral length of the connectors. Also, with the use of such bosses, it is likely that when the male and female shells are coupled together or uncoupled, the bosses may be exposed to large stresses that may deform them or impose wear on them, thereby causing a poor and unreliable connection to occur between the male and female shield.

The present invention is directed to an improved I/O connector that overcomes the aforementioned disadvantage of the prior art.

SUMMARY OF THE INVENTION

Accordingly, it is a general object of the present invention to provide an improved connector with a means for establishing a reliable connection between metal shields of opposing connectors.

Still another object of the present invention is to provide a connector having a connector body with a plurality of electrically conductive terminals, the terminals being surrounded by a metal shield, the connector including a plurality of individual, resilient engagement members disposed along the connector body, the engagement members extending out from the connector body into opposition to a metal shield of an opposing connector.

Yet a further object of the present invention is to provide an I/O connector having a metal shield surrounding a body portion of the connector, the body portion having a plurality of recesses, each of the recesses receiving a resilient engagement member that extend upward out of the cavities and through corresponding apertures formed in the metal shield.

These objects are accomplished by at least one principal aspect of the present invention in which a connector housing encloses a plurality of conductive terminals that are mounted to a mating projection thereof, the connector housing encircling the terminals and the connector housing having a metal shield surrounding the terminals and the shield having connecting means for establishing a reliable connection with the metal shield of an opposing connector.

In another principal aspect of the present invention, the connecting means includes a plurality of resilient, engagement members having a resilient engagement tongue portion cantilevered out from a support base portion, the engagement tongue portion extending through the metal shield of one connector in opposition to the metal shield of an opposing connector.

In yet another principal aspect of the present invention, the connector body portion includes a plurality of recesses formed therein, each recess receiving a single resilient engagement member therein, the metal shield of the connector having a plurality of corresponding apertures formed therein in registration with the recesses, the apertures having an open area that is less than the area of the recesses in order to enclose each of the engagement members therebetween, thereby permitting the resilient members to project through the apertures from the windows of the metal shell while the bases of the resilient members are press-fitted in the recesses of the mating projection.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of this detailed description, reference will be made to the accompanying drawings in which.

DESCRIPTION OF THE PREFERRED EMBODIMENTS

Figure 1:
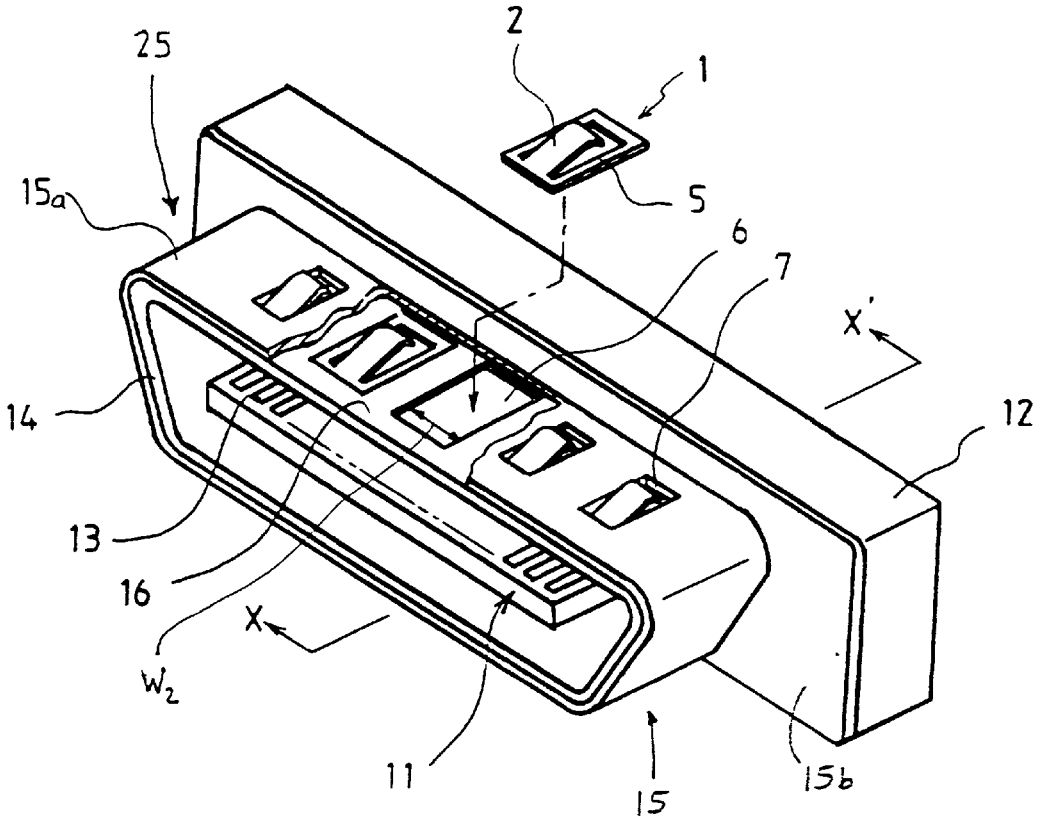
FIG. 1 is a perspective view, partially broken away, of a connector constructed in accordance with the principles of the present invention.

Referring now to FIG. 1, an electrical connector 25 of the input/output ("I/O") style is illustrated as having an insulative connector housing 12. The connector includes a connector blade or tongue 11 formed as part of the connector housing 12 and having a plurality of conductive contact terminals 13 mounted thereon. The connector also includes, as illustrated, an annular projection or shroud 14 also formed as part of the connector housing 12 that in effect, encircles the connector blade 11 and the contact terminals 13 arranged thereon. The connector 25, as is typically desired in I/O connectors, includes a metal shell, or shield, generally designated 15 including a shroud portion 15*a* and a flange portion 15*b* surrounding the shroud 14 as well as a flange 15 and overlying the exterior surface 16 of the shroud 14. This shield 15 may be considered as a "male" shield inasmuch as it is received within a "female" shield of an opposing connector (not shown). In an important aspect of the invention, the male shield 15 includes connecting means for establishing a reliable electrical connection with the opposing female shield of an opposing connector that is to be engaged with the connector illustrated.

Figure 2:
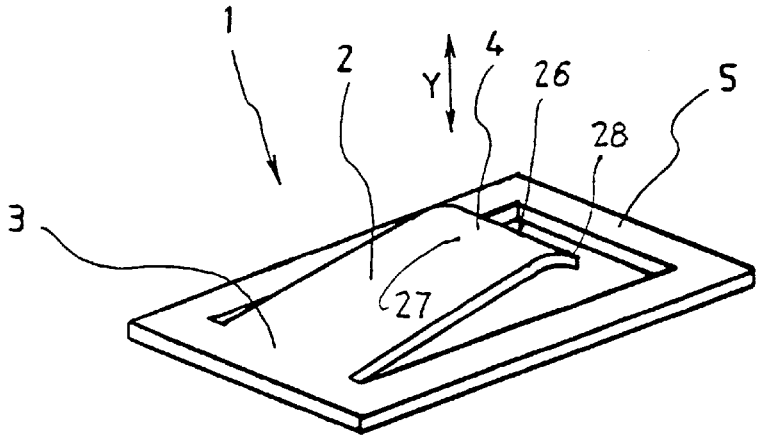
FIG. 2 is an enlarged perspective view of a first embodiment of a resilient engagement member in accordance with the present invention.

The connecting means includes a plurality of resilient, engagement members 1 that are preferably formed from a conductive material, such as metal and which are spaced apart from each other along the projection 14 of the connector housing 12. As shown in greater detail in FIG. 2, each engagement member 1 includes a support base 5 with a tongue, or contact portion, 2 that extends therefrom in what may be considered a cantilevered fashion. The engagement tongues 2 are bounded by the support base 5 and project upwardly therefrom at a predetermined angle.

In order to accommodate the engagement members 1, the annular projection 14 preferably includes a plurality of recesses 6 formed thereon. Each recess 6 is dimensioned to receive a single engagement member 1 therein as illustrated in FIG. 1. The metal shield 15 includes a plurality of apertures 7 that are positioned in registration with the recesses 6, thereby permitting the cantilevered tongue portions 2 of the engagement members 1 to project through the apertures 7 of the metal shield 15. The support bases 5 of the resilient members 1 have respective lengths and widths, $L_1$, $W_2$ that are closely dimensioned to match the respective lengths and widths of the recesses 6, $L_2$, $W_2$ so that the engagement members 1 may be press-fit in the recesses 6 and retained in place on the annular projection 14.

The support bases 5 and their corresponding recesses 6 are dimensioned so that they are slight larger in their respective lengths and widths than the lengths and widths of the shield apertures 7 such that a portion of the metal shield 15 disposed along and preferably adjacent to the edges of the apertures 7 overlies portions of the recesses 6 and preferably those portions that receive the support bases 5 of the engagement members 1. More specifically, the bases 5 of the resilient members 1 are press-fitted in the recesses 6 of the mating projection 14, and then, the annular metal shield 15 may be affixed onto the projection 14 in a known manner, such as by press fitting. The difference in dimensions between the shield apertures 7 and the engagement members 1 permits the shield 15 to hold the resilient engagement members 1 in place on the connector and in their associated recesses 6 by sandwiching the support bases 5 of the engagement members therebetween. By holding the engagement members 1 in place by way of their support bases 5, the cantilevered tongue portions 2 of the engagement members 1 will project through the shield apertures 7 to form a shield connecting means.

Figure 3:
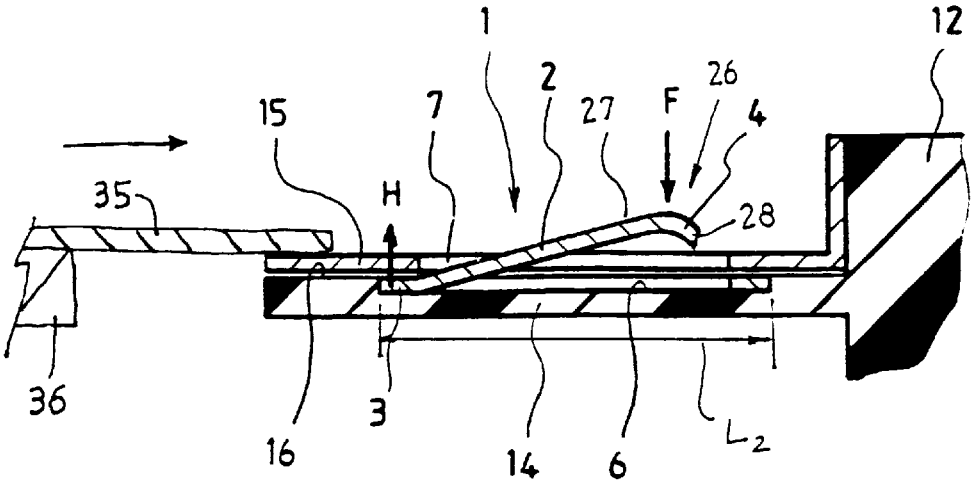
FIG. 3 is a cross-sectional view of the connector of FIG. 1, taken along line X-X' thereof, illustrating how an opposing connector is mated to the connector of FIG. 1.

Referring again to FIG. 2, each engagement member support base is illustrated as having a square or rectangular in configuration, although it will be understood that other configurations will also be suitable. As mentioned above, the tongue portion 2 of the engagement member 1 is inclined with respect to the support base 5 and is integrally fastened thereto at a joint of one end 3 of the tongue portion 2. The other, opposite end 26 of the tongue portion 2 terminates in a bent end portion 27 that may include a slight downward tang portion 28 at its end. (FIG. 3.) The tang portion 28 and the tongue portion 2 are angularly offset from each other and intersect to create a crown, or contact surface 4, on the engagement member 1. This contact surface 4 will abuttingly engage the interior surface of a female metal shield 35 of an opposing connector 36 when engaged with the connector 25 as suggested by FIG. 3.

The engagement member 1 can be formed by stamping and forming the tongue and base portions from a sheet of conductive material. A resilient, conductive material, such as spring steel, copper or the like is preferably used to form the engagement members 1. The engagement members 1 engage the connector mating projection 14 and are held in place in their associated recesses 6 by the male metal shield 15. The tongue portions 2 extend outwardly from the connector projection 14 and upwardly through the shield aperture 7 in order to contact the overlying female metal shield of an opposing connector at as many locations as desired to thereby establish good and reliable electric contact between the two metal shields of the opposing connectors when mated together.

Referring now to FIG. 3, it can be seen that when two such opposing connectors are mated together, the female metal shield 35 of the opposing connector 36 will contact the tongue portions 2 as the opposing connector 36 is engaged and exert a downward force F that will tend to depress the free end 26 of every cantilevered tongue portion 2 downward. A countering force H is generated at the joint 3 of the engagement member 1 where the tongue portion 2 joins the support base 5 that will tend to counteract the depressing force F and will act, in effect, to maintain the free end 26 of the tongue portion 2 up above the level of the metal shield 15. Thus, each cantilevered tongue 2 of every engagement member 1 is pushed against and maintained in contact with the overlying female metal shield of the opposing connector to ensure establishment of a reliable electrical connection between the metal shields of the engaged connectors.

Each resilient engagement member 1 acts independently from its enclosing metal shield 15, thereby minimizing any adverse effect that bending or deformation of the metal shield 15 may cause to the engagement members 1. Therefore, even if gaps of varying magnitude occur between the metal shields of the opposing connectors when mated together, the cantilevered tongue portions 2 will bend and compensate for such gaps. There is, therefore, less likelihood of a poor connection between the metal shields of opposing connectors when mated together.

When the two opposing connectors are mated together, the cantilevered tongue portions 2 of the engagement members 1 are yieldingly deformed, causing no perpetual deformation. Also, the yielding bending or deformation of resilient members in response to application of strong force from the overlying metal shell will effectively prevent application of counter stress to the overlying metal shell, and therefore the metal shield 15 is less likely to become deformed or worn even if a strong disengagement force is generated upon disengagement of one shield from the other.

Figure 4:
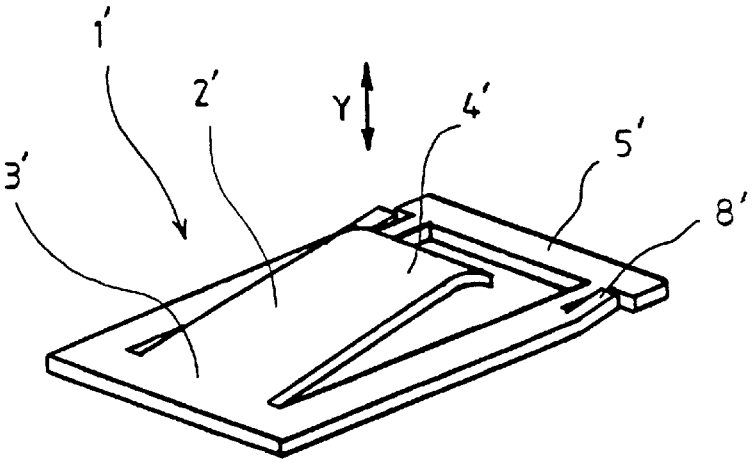
FIG. 4 is an enlarged perspective view of a second embodiment of a resilient engagement member in accordance with the present invention.

In FIG. 4, another embodiment of engagement member 1' is illustrated as having projections 8' to assure that the engagement member 1' will be capable of establishing a reliable connection between the metal shields 15 of opposing connectors when mated together even though insufficient pushing forces F and counter forces H are generated as illustrated in FIG. 3. These projections 8' of the resilient member 1' can be formed as bosses, resilient pieces or any other forms appropriate for making a connection. Preferably, the projections 8' take the form of resilient legs that extend upward from their associated support base 5' into contact with the overlying metal shield 15 and which apply an external force to the metal shield 15.

Figure 5:
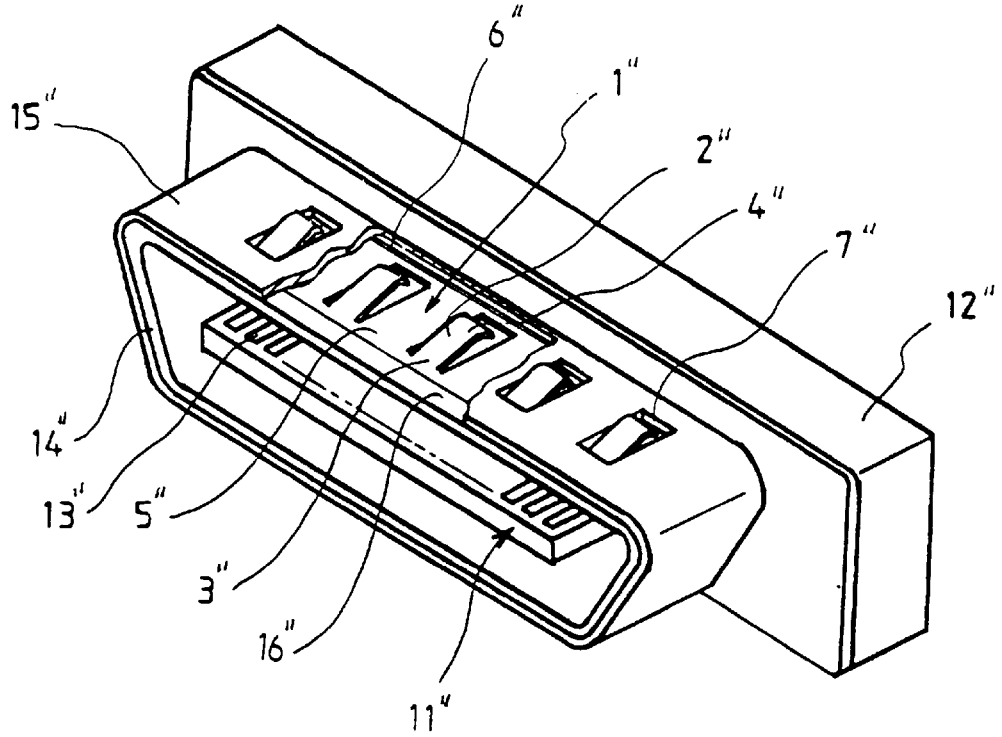
FIG. 5 is a perspective view similar to FIG. 1 of another I/O connector utilizing another embodiment of a resilient engagement member constructed in accordance with the principles of the present invention: and, FIG. 6 is a detailed perspective view of the series-style engagement member strip shown in FIG. 5.
Figure 6:
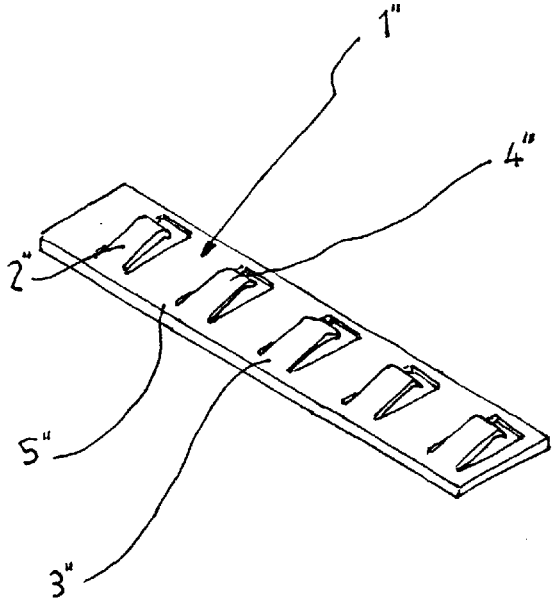

Referring now to FIG. 5, another embodiment of a metal shield connecting means constructed in accordance with the principles of the present invention is shown as a series-connection of engagement members 1". In this embodiment, the support bases 5" of adjacent engagement members 1" are formed together so that they are all connected to each other. This series connection facilitates the mounting of the engagement members 1" onto the connector projection 14" by utilizing a single recess 6" into which the series assembly is press-fit. This series style arrangement will contribute to a reduction in the manufacturing cost of the connector.

It will be understood that the embodiment of the present invention which has been described herein is merely illustrative of some of applications of the principles of the present invention. Various modifications may be made by those skilled in the art without departing from the true spirit and scope of the invention.

We claim:

1. An electric connector of the type having a insulative connector housing, a portion of which includes conductive shield disposed on an exterior surface of the connector housing, the connector comprising: a plurality of individual engagement members supported on the connector housing, each engagement member having a base portion and a tongue portion that extends from the base portion in a cantilevered fashion and terminates in a free end, the tongue portion free end extending above said connector housing and said shield disposed thereon, said connector housing including a plurality of recesses formed in a surface thereof, said recesses being equal in number to that of said engagement members, one engagement member being disposed in a corresponding one of said connector housing recesses, said shield having a plurality of apertures aligned with said connector housing recesses, whereby said tongue portion free ends project through said connector housing apertures in a position to contact a second shield of a second connector when said second connector is mated to said connector.

2. The connector as claimed in claim 1, wherein said apertures have respective lengths and widths that are less than corresponding respective lengths and widths of said recesses, whereby said engagement members are sandwiched between said connector housing and said shield.

3. The connector as claimed in claim 2, wherein said support base portions are sandwiched between said connector housing and said shield.

4. The connector as claimed in claim 1, wherein said engagement member tongue portions extend at an angle to said base portions.

5. The connector as claimed in claim 1, wherein said tongue portion free end includes a bent end portion that extends at an angle to said tongue portion, said bent end portion and said tongue portion cooperatively defining a contact surface of said engagement member that projects through an associated aperture in opposition to said second shield of said second connector.

6. The connector as claimed in claim 1, wherein said engagement members are press fit into said recesses.

7. The connector as claimed in claim 1, wherein said shield overlies said support portions.

8. The connector as claimed in claim 7, wherein said support portions include tang portions that extend outwardly therefrom into contact with said overlying shield.

9. The connector as claimed in claim 1, wherein said engagement members are stamped and formed from a conductive, resilient material.

10. The connector as claimed in claim 1, wherein said engagement members are spaced apart from each other and separated by a predetermined spacing.

11. An I/O connector, comprising: a connector housing formed from an electrically insulative material, the connector housing having a pedestal and a projection surrounding the pedestal, a plurality of electrically conductive terminals disposed on the connector housing pedestal, said connector further having an electrically conductive metal shield overlying the connector housing projection, the metal shield having at least one aperture formed therein, said connector housing projection including at least one recess formed therein, said metal shield aperture being aligned with said recess such that said metal aperture communicates with said recess, and at least one electrically conductive engagement member for engaging an opposing connector, the engagement member having a base portion that is received by said connector housing projection recess, said engagement member further having a contact portion with opposing first and second ends, said contact portion first end being joined to said base portion and said contact portion second end extending from said base portion in a cantilevered fashion and terminating in a free end, said contact portion extending out of said recess and projecting through said metal shield aperture for an extent sufficient to contact a metal shield of the opposing connector, when mated to said connector to establish an electrical connection therebetween.

12. The I/O connector as set forth in claim 11, wherein said metal shield includes a plurality of spaced-apart apertures formed therein that open into said recess, and said engagement member includes an elongated conductive strip and a plurality of contact portions spaced apart from each other, the contact portions being arranged such that they are aligned with said shield apertures and project therethrough.

13. The I/O connector as set forth in claim 10, wherein said connector housing projection includes a plurality of recesses formed therein, and said connector includes a plurality of individual engagement members, one of said engagement members being disposed in a corresponding one of said recesses, said metal shield further including a plurality of apertures formed therein, one of said apertures being associated with a corresponding one of said recesses, said metal shield overlying said member base portions to thereby retain said engagement members in said corresponding recesses.

14. The I/O connector as set forth in claim 13, wherein said engagement members are press fit into said recesses.

15. The I/O connector as set forth in claim 13, wherein said engagement members include tang portions that extend from said base portions thereof into contact with an opposing surface of said metal shield.

16. The I/O connector as set forth in claim 11, wherein said engagement members have respective lengths and widths that are greater than corresponding respective lengths and widths of said apertures, whereby said metal shield retains said engagement members in place within said apertures.

17. The I/O connector as set forth in claim 11, wherein said contact portions include a bend proximate to said free end, the bend defining a contact surface, said bend separating said contact portion into respective first and second portions, said contact portion first portion being angularly offset with respect to said contact portion second portion.

18. A connector, comprising: a housing formed from an electrically insulative material, the housing having an engagement end for engaging an opposing connector, said housing engagement end having a continuous projection therefrom, the projection surrounding a portion of a plurality of electrical contacts, a metal shield disposed on an exterior surface of said projection, said projection including a plurality of recesses formed therein and said shield including a like plurality of apertures aligned with said recesses and communicating therewith, said connector further including a plurality of engagement members disposed in said recesses, each of said engagement members including base portions received within said recesses, said engagement members further including contact portions projecting from said base portions, said contact portions extending away from said base portions and out of said shield apertures and further away from said connector housing, said contact portions engaging a second metal shield extending from said opposing connector when said connector is engaged with said opposing connector.

19. The connector as claimed in claim 18, wherein said contact portions are integrally formed with said base portions.

20. The connector as claimed in claim 18, wherein each of said contact portions has a free end with a contact surface formed thereon, said contact surface being disposed above the level of said shield.

* * * * *